US007418967B2

(12) United States Patent
Kim

(10) Patent No.: US 7,418,967 B2
(45) **Date of Patent: *Sep. 2, 2008**

(54) DISHWASHER

(75) Inventor: Yong Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 540 days.

This patent is subject to a terminal disclaimer.

(21) Appl. No.: 10/861,361

(22) Filed: Jun. 7, 2004

(65) Prior Publication Data

US 2005/0039782 A1 Feb. 24, 2005

(30) Foreign Application Priority Data

Aug. 20, 2003 (KR) ..... 10-2003-0057569

(51) Int. Cl.
*A47L 15/50* (2006.01)

(52) U.S. Cl. ..... 134/57 D; 134/58 D; 134/201; 312/351; 312/334.4; 211/41.8

(58) Field of Classification Search ..... 134/57 D
See application file for complete search history.

(56) References Cited

U.S. PATENT DOCUMENTS 3,472,573 A * 10/1969 Geiger ..... 312/351
3,761,153 A * 9/1973 Guth ..... 312/351

FOREIGN PATENT DOCUMENTS

| | | |
|---|---|---|
| CH | 690488 | 9/2000 |
| DE | 4228954 | 3/1994 |
| DE | 10120577 | * 10/2002 |
| EP | 0848930 | 6/1998 |
| KR | 20-1989-0002448 | 4/1989 |

* cited by examiner

*Primary Examiner*—Michael Barr
*Assistant Examiner*—Jason P Riggleman
(74) *Attorney, Agent, or Firm*—Ked & Associates, LLP

(57) ABSTRACT

A dishwasher including an improved rack adjustment system is provided. The dishwasher includes a chamber for washing dishes, guide rails at opposite inside walls of the chamber, and a rack that moves along the guide rails into and Out of the chamber for holding dishes. A supporter may be provided at opposite sides of the rack for guiding an up/down movement of the rack along the guide rail, with a locker provided on an outside surface of the supporter for holding the rack in position. A handle may be provided on the outside surface of the supporter to swing in up/down directions to a force to the locker and adjust the rack downward, thereby permitting easy adjustment of rack height.

27 Claims, 7 Drawing Sheets

DISHWASHER

This application claims the benefit of the Korean Application No. P2003-57569 filed on Aug. 20, 2003, which is hereby incorporated by reference.

BACKGROUND OF THE INVENTION

1. Field of the Invention

The present invention relates to dish washers, and more particularly, to a dish washer in which a height of the rack can be adjusted, easily.

2. Background of the Related Art

In general, the dish washer sprays detergent and washing water to dishes automatically, to wash the dishes, and dries the dishes. The dish washer is provided with a chamber for making washing of the dishes therein, racks in the chamber for receiving the dishes, and guide rails at opposite sidewalls of an inside of the chamber.

The racks are in an upper part and a lower part of the chamber, and have structures to enable to take the dishes out of the chamber following the guide rails. The racks have structures to enable height adjustment according to a size of the dishes placed thereon.

That is, if a user intends to wash small dishes, the user increases a height of the rack, and, if a user intends to wash large dishes, the user reduces a height of the rack.

The rack height adjustment is made by a rack height adjusting device. For this, the rack height adjusting device is provided with a holding part for holding a moved up rack, and a button for separating the rack from the fastening part, and moving down the rack. Therefore, if the user intends to lower the height of the rack, the user draws the rack out of the chamber, and presses the button on the rack height adjusting device.

However, the related art dish washer has a structure in which the user can not hold the rack in the rack height adjustment. Therefore, if the user presses the button for lowering the rack height, the rack, separated from the holding part, moves down instantly by gravity, to give impact to the rack. Particularly, if the rack is loaded with heavy dishes, the dishes are liable to break due to the impact applied to the rack.

SUMMARY OF THE INVENTION

Accordingly, the present invention is directed to a dish washer that substantially obviates one or more of the problems due to limitations and disadvantages of the related art.

An object of the present invention is to provide a dish washer which enables an easy rack height adjustment.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the dish washer includes a chamber for making washing of dishes, guide rails at opposite inside walls of the chamber, a rack in the chamber for holding the dishes, a supporter at opposite sides of the rack for guiding up/down movement of the rack along the guide rail, a locker on an outside surface of the supporter for holding the rack having moved upward, and a handle on the outside surface of the supporter to swing in up/down directions for applying a force to the locker, to move down the rack having moved upward.

The dish washer further includes a plurality of rollers on the outside surface of the supporter for moving along the guide rail.

The locker is rotatably mounted on the supporter with a hinge pin provided at a central part of an upper surface. The locker includes a seating part at one end for seating the rack moved upward, and a sloped part at the other end for smooth rotation of the locker.

The dish washer further includes an elastic member between the sloped part and the supporter for returning the locker to an original position if an external force applied to the locker by the handle is removed.

The seating part includes a sloped surface in a lower part, and the handle includes an operating part in a lower part for coming into contact with the sloped surface of the seating part and applying an external force to the locker. It is preferable that the operating part includes a sloped part to be in contact with the sloped surface.

The supporter includes a vertical guide slot, and the handle includes a hook to be inserted in the guide slot and moving following the guide slot when the handle is rotated.

The locker is rotatably mounted on the supporter with a hinge pin at a central part of an upper surface of the supporter.

The locker includes a seating part at one end for placing the rack moved upward, and a sloped part at the other end for smooth rotation of the locker.

The dish washer further includes an elastic member between the sloped part and the supporter for returning the locker to an original position if an external force applied to the locker by the handle is removed, and the handle includes an operating part in a lower part for coming into contact with the sloped surface of the seating part and applying an external force to the locker.

The dish washer further includes one pair of vertical bars at opposite sides of the rack spaced away from each other, and a horizontal bar between the one pair of the vertical bars.

The supporter includes a plurality of guides at opposite ends for engaging with the vertical bars and guiding up/down movement of the vertical bars, and the vertical bar includes a holder at a lower end for preventing the guide and the vertical bar from breaking away.

The supporter includes a stopper in a lower part for supporting the horizontal bar moved down, and the locker is rotatably mounted on the supporter with a hinge pin at a central part of an upper surface of the supporter.

The locker includes a seating part at one end for placing the rack moved upward, and a sloped part at the other end for smooth rotation of the locker. The dish washer further includes an elastic member between the sloped part and the supporter for returning the locker to an original position if an external force applied to the locker by the handle is removed.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
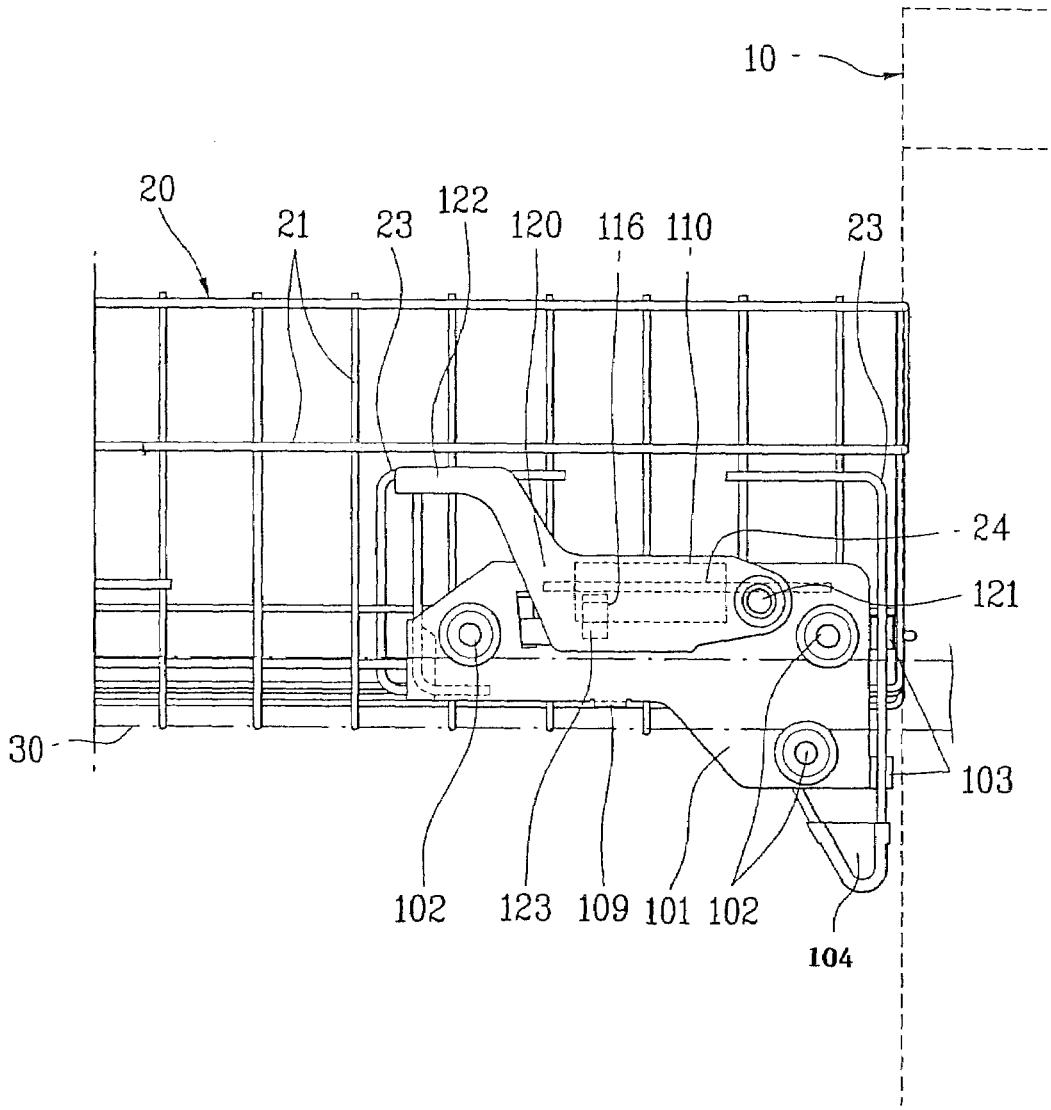
FIG. 1 illustrates a front view of a dish washer in accordance with a preferred embodiment of the present invention.
Figure 2:
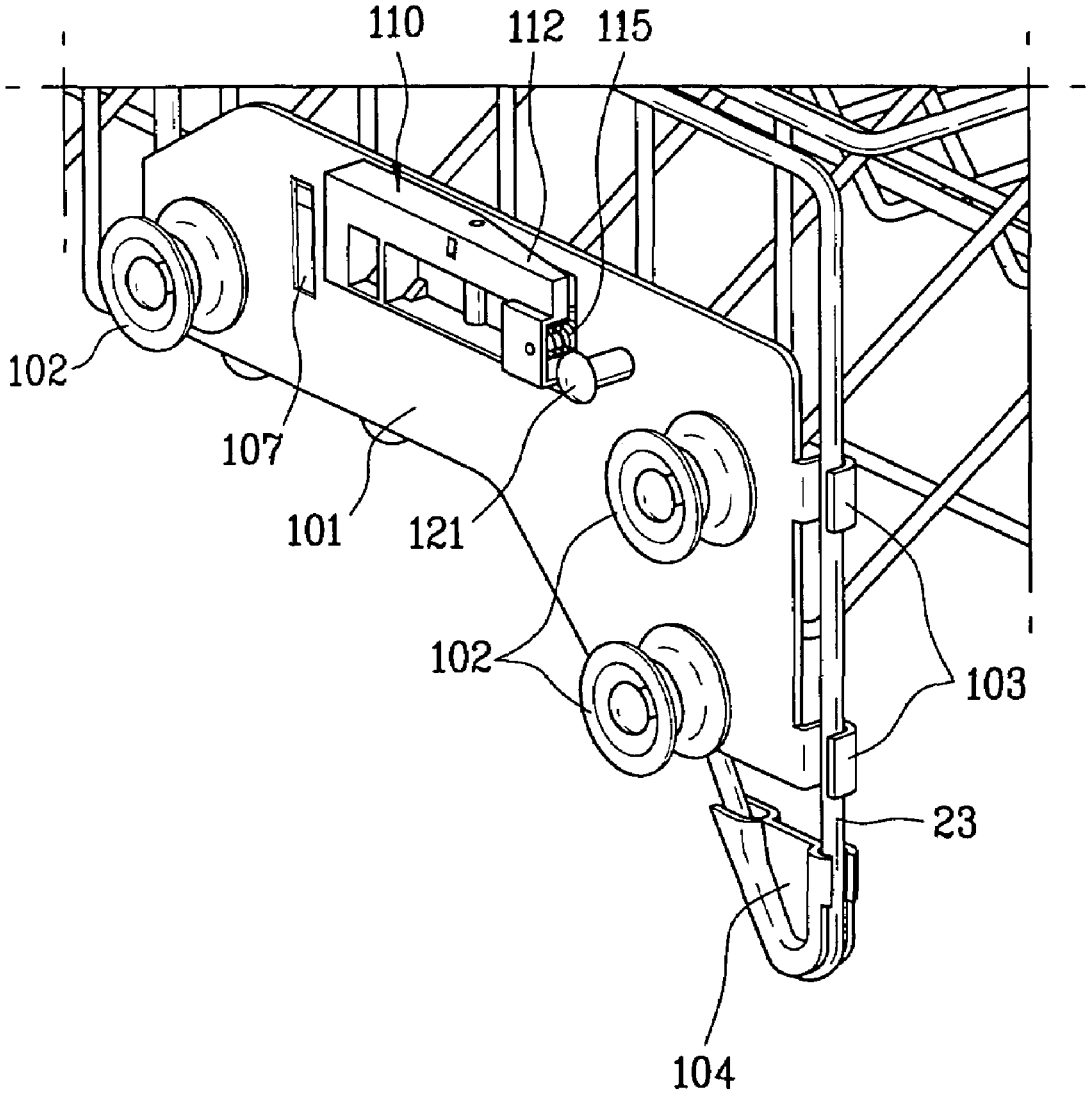
FIG. 2 illustrates a perspective view of a supporter, and a locker in accordance with a preferred embodiment of the present invention.

Referring to FIGS. 1 and 2, the dish washer includes a chamber 10 for making washing of the dishes, guide rails 30 at opposite inside walls of the chamber 10, racks 20, and supporters 101, a locker 110, and a handle 120.

The rack 20 has a structure of a net of a plurality of steel bars 21 connected to one another for smooth pass of washing water. The supporter 101 is mounted at opposite sides of the rack 20 for guiding up/down movement of the rack 20 along the guide rail 30. The locker 110 is mounted on an outside surface of the supporters 101 for holding the rack 20 having moved upward.

The handle 120 is mounted on the outside surface of the supporter 101 to swing in up/down directions for applying a force to the locker 110, to move down the rack 20 having moved upward. In more detail, one end of the handle 120 is mounted on the outside surface of the supporter 101 with a rotatable shaft 121. The handle 120 has a grip 122 in an upper part of the other end for easy handling of the handle 120. Therefore, if the user moves up the grip 122, the handle 120 rotates around the rotatable shaft 121.

In the meantime, there are one pair of vertical bars 23 joined with the supporter 101 at opposite sides of the rack 20 spaced from each other, and a horizontal bar 24 between the one pair of the vertical bars 23.

There are a plurality of guides 103 engaged with the vertical bars 23 for guiding up/down movement of the vertical bars 23. The guide is bent to a semicircular form to surround an outside surface of the vertical bar 23. Accordingly, if the vertical bars 23 move along the guide 103, the rack 20 also moves up/down.

There is a holder 104 at a lower end of the vertical bar 23 for preventing the guide 103 and the vertical bar 23 from breaking away. The holder 104 bars the lower end of the vertical bar 23, for preventing the guide 103 from breaking away through the lower end of the vertical bar 23.

There is a stopper 109 in a lower part of the supporter 101 for supporting the horizontal bar 24 moved downward. The stopper 109 is bent inwardly for seating the horizontal bar 24 (see FIG. 4).

Therefore, the horizontal bar 24 is supported on the locker 110 when the rack 20 is moved upward, and the rack 20 is supported on the stopper 109 when the rack 20 is separated from the locker 110, and moved down.

In the meantime, there are a plurality of rollers 102 on an outside surface of the supporter 101 for moving along the guide rail 30. The rollers 102, in contact with top of the guide rail 30, enables smooth movement of the supporter 101 along the guide rail.

Figure 3A:
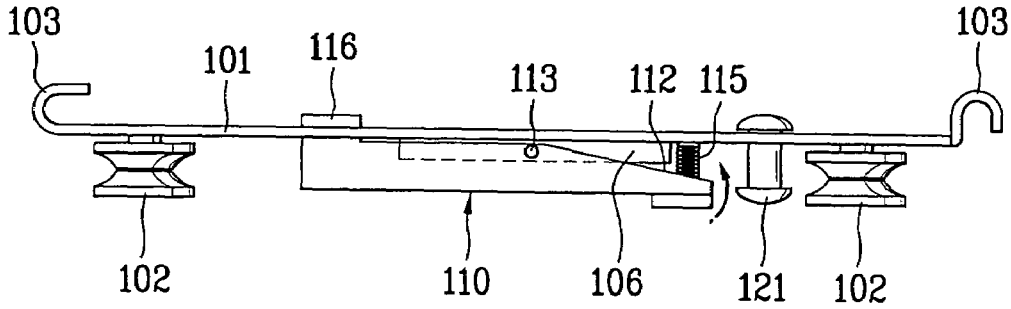
FIGS. 3A and 3B illustrate plan views each showing operation of a locker of the present invention.
Figure 3B:
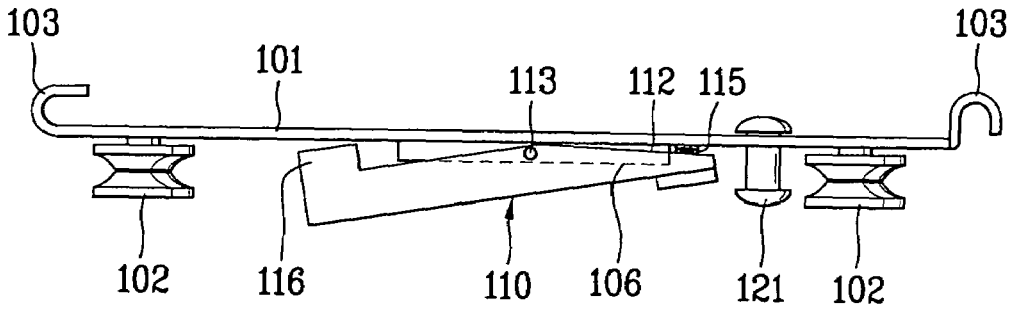

Referring to FIGS. 3A and 3B, the locker 110 is rotatably mounted on the supporter 101 with a hinge pin 113 at a central part of an upper surface. In more detail, the hinge pin 113 is passed through the central part of the upper surface of the locker 110, and inserted in a projected surface 106 from the supporter 101.

Accordingly, when the handle 120 applies an external force to the locker 110, the locker 110 rotates around the hinge pin 113 toward a side of the supporter 101. The locker 110 has one end with a seating part 116 for seating the rack 20 moved upward, and the other end with a sloped part 112 for smooth rotation of the locker 110.

The seating part 116 is extended to an inside of the supporter 101, and has a flat surface 116*a* (see FIG. 4) in an upper part for seating the rack 20. The sloped part 112 has a width which becomes the smaller as it goes toward an end, such that the locker 110 rotates smoothly without interference with the supporter 101.

There is an elastic member 115 between the sloped part 112 and the supporter 101, for making the locker 110 to return to an original position if the external force applied to the locker 120 by the handle 120 is removed.

The elastic member 115 makes the locker 110 to return to the original position as the elastic member 115 restores from compression following rotation of the locker 110. It is preferable that, as the elastic member 115, a compression coil spring is used.

Figure 4:
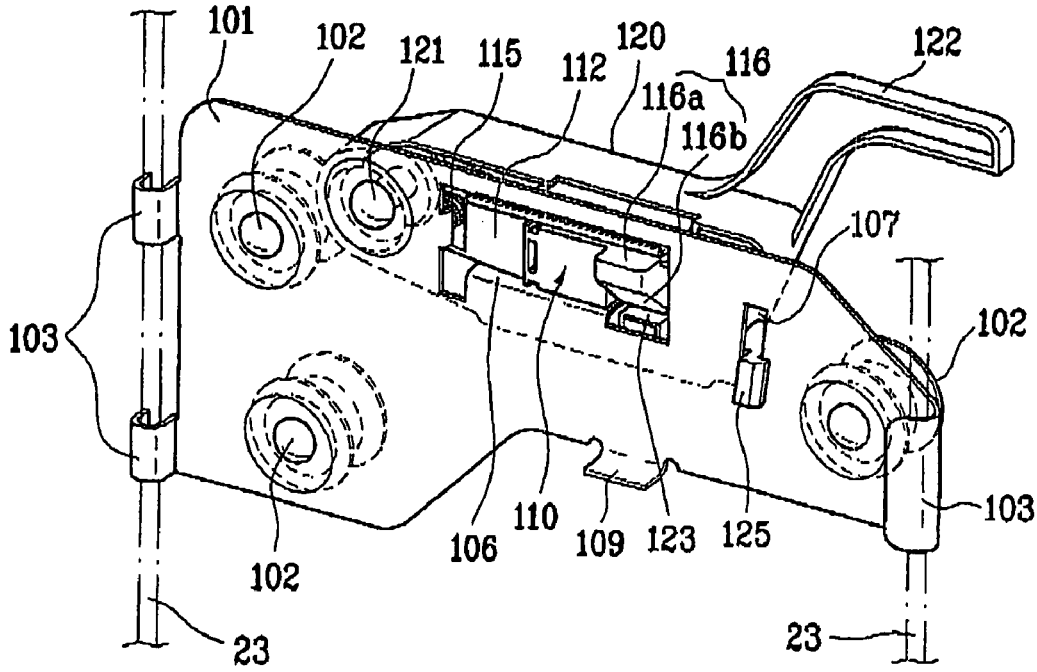
FIGS. 4 and 5 illustrate perspective views each showing operation of a handle and a locker of the present invention.
Figure 5:
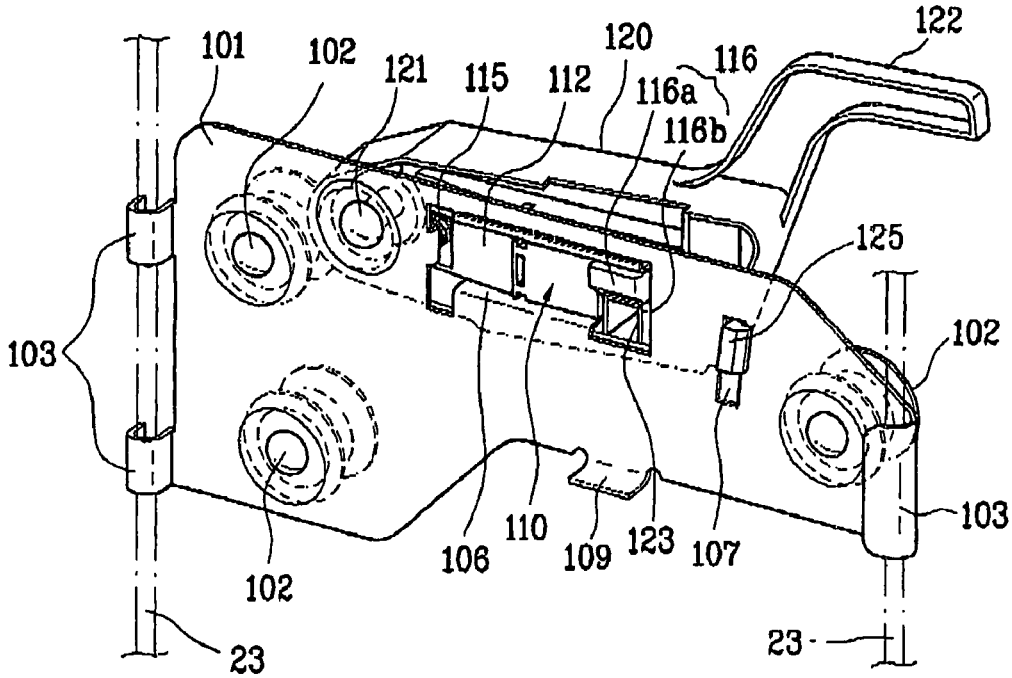

In the meantime, referring to FIG. 4, the seating part 116 has a sloped surface 116*b* in a lower part. The handle 120 has an operating part 123 in a lower part for coming into contact with the sloped surface 116*b*, and applying an external force to the locker 110. As shown in FIG. 5, the operating part 123 comes into contact with the sloped surface 116*b* at the time of upward rotation of the handler 120, so that the locker 110 rotates to a side of the supporter 101.

It is preferable that the upper part of the operating part 123 in contact with the sloped surface 116*b* is sloped. This structure enables smoother rotation of the locker 110 when the handle 120 rotates upward by making the operating part 123 to slide on the sloped surface 116*b*.

In the meantime, the supporter 101 has a vertical guide slot 107, and the handle 120 has a hook 125 for inserting into the guide slot 107, and moving along the guide slot 107 when the handle 120 rotates. The hook 125 fastens the handle 120 to the supporter 101, as well as limits rotation range of the handle 120.

In the foregoing embodiment of the present invention, the vertical bars 23 and the horizontal bar 24 are provided. However, the vertical bars 23 and the horizontal bar 24 may not be provided, but the plurality of bars 21 of the rack 20 may be deformed appropriately, for using as the vertical bars 23 and the horizontal bar 24 instead.

The rack height adjustment of the dish washer of the present invention can be made as follows. At first, a case when the rack 20 is moved down from a state the rack 20 is moved up will be described.

Figure 6:
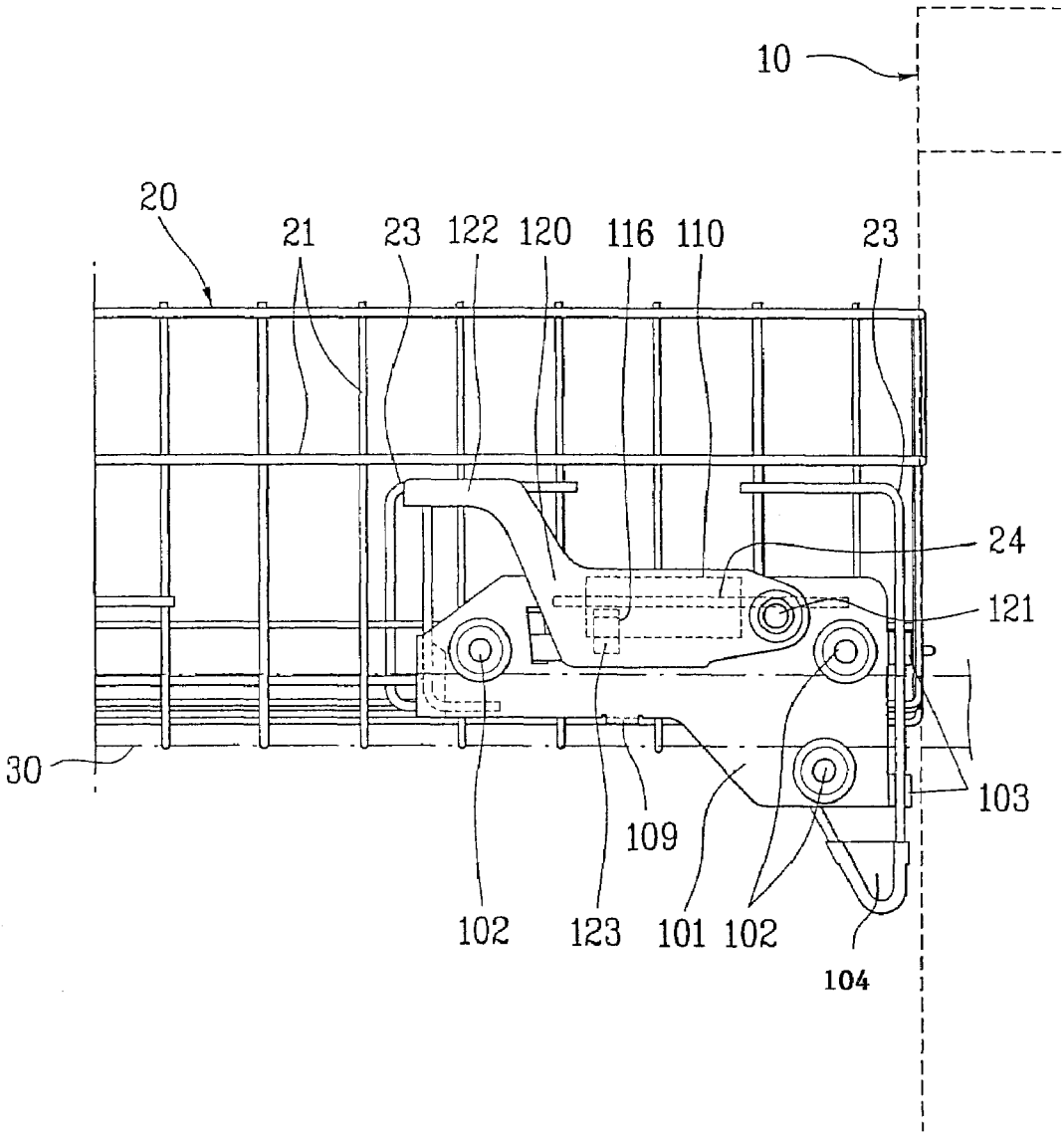
FIG. 6 illustrates a front view showing a state in which the rack height is adjusted upward.

Referring to FIG. 6, if the user holds a front part of the rack 20, and pulls the rack 20 an outside of the chamber 10 for adjusting the height of the rack 20, the rollers 102 on the supporter 101 rolls along the rail 30, to draw the rack 20 to the outside of the chamber.

Then, as shown in FIG. 5, if the user pulls the grip 122 of the handle 120 upward with a finger, the handle 120 rotates upward around the rotatable shaft 121, such that the operating part pushes the sloped surface 116*b* upward.

In this instance, as shown in FIG. 3B, the locker 110 rotates around the hinge pin 113, and the seating part 116 also rotates toward an outside of the supporter 101. According to this, the seating part 116 is separated from the horizontal bar 24, and the rack 20 moves down by gravity.

Figure 7:
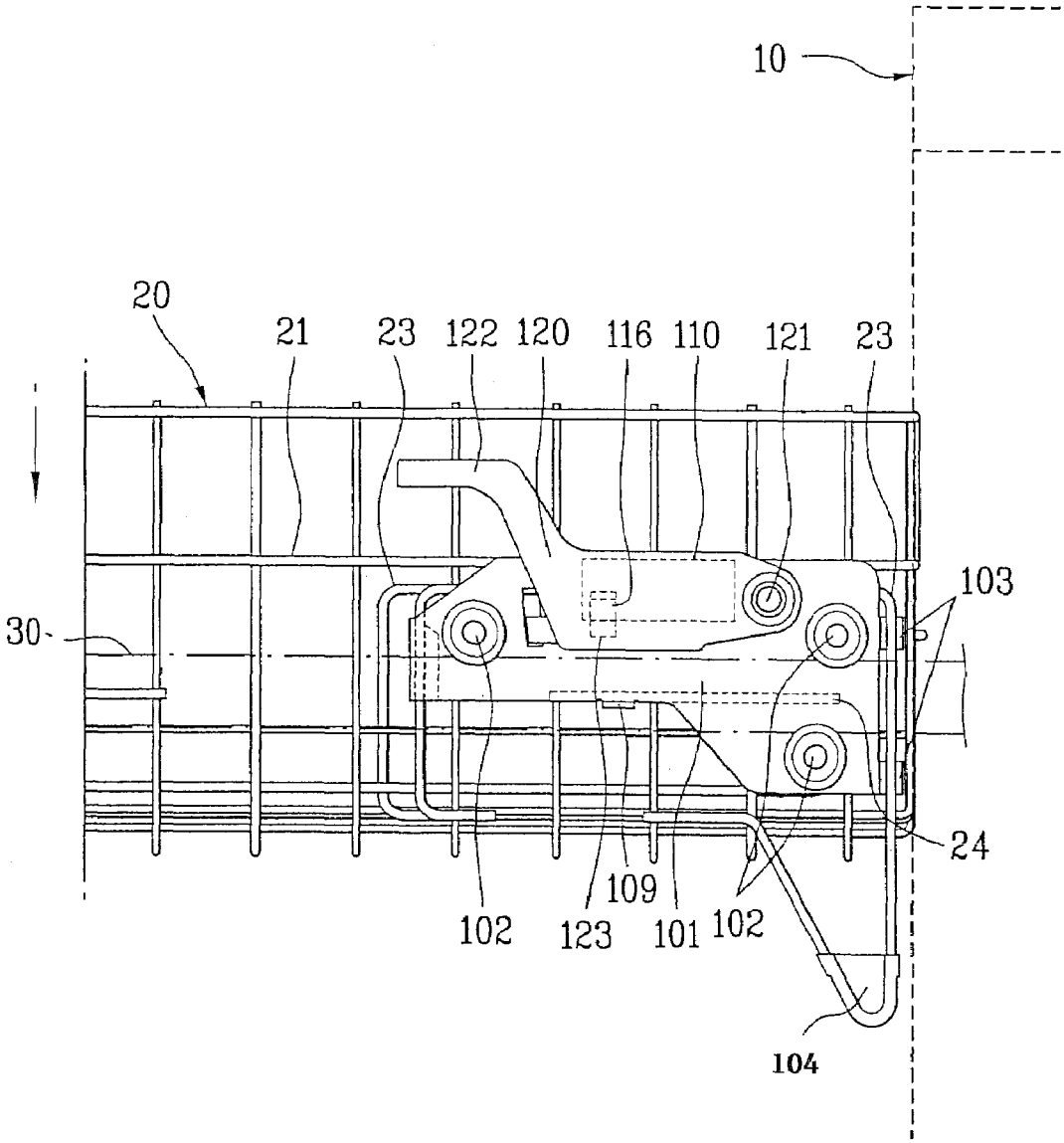
FIG. 7 illustrates a front view showing a state in which the rack height is adjusted downward.

Then, referring to FIG. 7, the rack 20 is held at a fixed position without moving down any more as the horizontal bar 24 stops, and held at the stopper 109.

In the meantime, in a handle 120 rotating action for moving down the rack 20 thus, some of the fingers of the user become to hold the rack 20, naturally. That is, when the user manipulates the handle 120, the user holds an upper part of the rack 20 with a thumb and a second finger, and lifts the grip of the handle 120 with a third finger or a fifth finger.

Therefore, even in a case the rack 20 is separated from the seating part 116 of the locker 110 by the rotation of the handle 120, since the rack 20 is held by the thumb and the second finger of the user, sudden drop of the rack 20 is prevented.

Next, when it is intended to move the moved down rack 20 upward, the user holds opposite sides of the rack 20, and lifts the rack 20 without manipulating the handle 120. In this instance, the horizontal bar 24 naturally rotates the locker 110 as the horizontal bar 24 of the rack 20 passes the sloped surface 116*b* of the seating part 116.

Then, when the horizontal bar 24 of the rack 20 is out of the seating part 116, the seating part 116 is projected to an inside of the supporter 101 again as the seating part 116 is returned to an original position by the elastic force of the elastic member 115. As shown in FIG. 6, if the rack 20 is put down again, the horizontal bar 24 of the rack 20 is placed on an upper surface of the seating part 116.

The dish washer of the present invention has the following advantages.

First, since the height of the rack can be adjusted by a simple operation of rotating the handle, the adjustment of rack height is very easy.

Second, the natural holding of the rack with users fingers at the time of downward movement of the rack permits to prevent the rack from moving down suddenly involving an impact.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dish washer, comprising:

a chamber;

guide rails provided at opposite inside walls of the chamber;

a rack provided in the chamber and coupled to the guide rails;

a supporter provided on opposite sides of the rack, wherein the supporter includes a stopper that extends from the supporter towards a corresponding side of the rack, and wherein the supporter guides movement of the rack along the guide rail;

a locker rotatably coupled to an outside surface of the supporter, wherein the locker includes a seating part that supports the rack in a first position, and wherein the stopper supports the rack in a second position; and a handle rotatably coupled to the supporter and the locker, wherein the handle rotates about a horizontal axis of rotation so as to apply a force to the locker that rotates the locker about a vertical axis of rotation to move the rack from the first position to the second position.

2. The dish washer as claimed in claim 1, further comprising a plurality of rollers provided on the outside surface of the supporter, wherein the plurality of rollers move along the guide rail so as to slide the rack into and out of the chamber.

3. The dish washer as claimed in claim 1, wherein the locker is rotatably coupled to the supporter by a hinge pin provided at an upper central portion of the supporter.

4. The dish washer as claimed in claim 3, wherein the seating part extends from a first end of the locker, wherein the locker further comprises a first sloped part provided at a second end thereof, and wherein the first sloped part provides for smooth rotation of the locker about the hinge pin.

5. The dish washer as claimed in claim 4, further comprising an elastic member positioned between the first sloped part of the locker and the supporter, wherein the elastic member returns the locker to an original position when an external force applied to the locker by the handle is removed.

6. The dish washer as claimed in claim 4, further comprising a second sloped part that extends along a lower portion of the seating part.

7. The dish washer as claimed in claim 6, further comprising an operating part provided at a lower portion of the handle, wherein the operating part of the handle contacts the second sloped part of the seating part to apply an external force to the locker.

8. The dish washer as claimed in claim 1, wherein the locker is rotatably coupled to the supporter by a hinge pin provided at an upper central portion of the supporter.

9. The dish washer as claimed in claim 8, wherein the seating part is provided at a first end of the locker, and wherein the locker further comprises a first sloped part at a second end thereof, and wherein the first sloped part provides for smooth rotation of the locker about the hinge pin.

10. The dishwasher as claimed in claim 9, further comprising an elastic member positioned between the first sloped part of the locker and the supporter, wherein the elastic member returns the locker to an original position when an external force applied to the locker by the handle is removed.

11. The dishwasher as claimed in claim 9, further comprising an operating part provided at a lower portion of the handle, wherein the handle contacts the second sloped surface of the seating part to apply an external force to the locker.

12. The dish washer as claimed in claim 1, further comprising a pair of vertical bars positioned at opposite sides of the rack, and a horizontal bar extending between the pair of vertical bars.

13. The dish washer as claimed in claim 12, wherein the supporter includes a plurality of guides provided at opposite ends thereof that engage the vertical bars and guide an up/down movement of the supporter along the vertical bars.

14. The dish washer as claimed in claim 13, wherein at least one of the vertical bars includes a holder provided at a lower end thereof that prevents the guide and the vertical bar from separating.

15. The dish washer as claimed in claim 12, wherein the locker is rotatably coupled to the supporter by a hinge pin provided at an upper central portion of the supporter.

16. The dish washer as claimed in claim 15, wherein the seating part is provided at a first end of the locker, and wherein the locker further comprises a first sloped part provided at a second end thereof, and wherein the first sloped part provides for smooth rotation of the locker.

17. The dishwasher as claimed in claim 16, further comprising an elastic member provided between the first sloped part of the locker and the supporter, wherein the elastic member returns the locker to an original position when an external force applied to the locker by the handle is removed.

18. The dish washer as claimed in claim 1, wherein the first position is an upper position, and the second position is a lower position, wherein the rack is supported in the upper position by an engagement of the seating portion of the locker with a horizontal support bar of the rack, and the rack is supported in the lower position by an engagement of the stopper with a horizontal support bar of the rack.

19. The dish washer as claimed in claim 18, wherein the engagement between the seating portion and the horizontal support bar is released by a rotation of the handle about the horizontal axis of rotation.

20. The dish washer as claimed in claim 1, wherein the supporter includes a vertical guide slot, and the handle includes a hook that is inserted into the guide slot provided in the supporter so as to move along the guide slot when the handle is rotated.

21. A dishwasher, comprising:

a chamber;

a pair of guide rails provided at opposite side walls of the chamber;

a rack movably positioned within the chamber; and a height adjustment assembly provided on at least one side of the rack, wherein the height adjustment assembly adjusts a vertical position of the rack within the chamber, the height adjustment assembly comprising:

a plate vertically aligned between the side wall of the chamber and a corresponding side of the rack;

a locker provided on a surface of the plate facing a corresponding side wall of the chamber and rotatably coupled to the plate, wherein the locker is configured to be releasably coupled to the plate; and a lever rotatably coupled to the plate and the locker, wherein a rotation of the lever about a horizontal axis of rotation causes rotation of the locker about a vertical axis of rotation, and rotation of the locker about the vertical axis of rotation disengages the locker and plate coupled thereto from the rack.

22. The dish washer as claimed in claim 21, wherein the locker comprises:

a seating part provided at a first end thereof wherein the seating part supports the rack in a first position; and a first sloped part provided at a second end thereof, wherein the sloped part provides for rotation of the locker about the second axis of rotation.

23. The dish washer as claimed in claim 22, wherein the seating part of the locker comprises a second sloped part extending along a lower portion thereof, wherein the second sloped part maintains partial contact with the plate as the locker rotates relative to the plate.

24. The dish washer as claimed in claim 23, wherein the lever comprises an operating part provided at a lower portion thereof wherein a portion of the operating part of the lever contacts the second sloped part of the seating part of the locker as the lever rotates about the first axis of rotation.

25. The dish washer as claimed in claim 22, wherein the plate comprises a stopper provided at a lower portion thereof, wherein the stopper supports a horizontal support bar of the rack so as to support the rack in the second position.

26. A dishwasher, comprising:

a chamber;

a pair of guide rails provided at opposite side walls of the chamber;

a rack movably positioned within the chamber; and a height adjustment assembly provided on at least one side of the rack, wherein the height adjustment assembly adjusts a vertical position of the rack within the chamber, the height adjustment assembly comprising:

a plate vertically aligned between the side wall of the chamber and a corresponding side of the rack, wherein the plate includes a vertical guide slot;

a locker provided on a surface of the plate facing a corresponding side wall of the chamber and rotatably coupled to the plate, wherein the locker is configured to be releasably coupled to the plate; and a lever rotatably coupled to the plate and the locker and including a hook, wherein a rotation of the lever about a horizontal axis of rotation causes a rotation of the locker about a vertical axis of rotation, and the rotation of the locker about the vertical axis of rotation disengages the locker and plate coupled thereto from the rack, wherein the hook is inserted into the vertical guide slot and moves within the vertical guide slot as the lever rotates relative to the plate so as to guide the rotation of the lever about the horizontal axis of rotation.

27. A dishwasher, comprising:

a chamber;

a pair of guide rails provided at opposite side walls of the chamber;

a rack movably positioned within the chamber; and a height adjustment assembly provided on at least one side of the rack, wherein the height adjustment assembly adjusts a vertical position of the rack within the chamber, the height adjustment assembly comprising:

a plate vertically aligned between the side wall of the chamber and a corresponding side of the rack;

a locker provided on a surface of the plate facing a corresponding side wall of the chamber and rotatably coupled to the plate, wherein the locker is configured to be releasably coupled to the plate;

a lever rotatably coupled to the plate and the locker, wherein a rotation of the lever about a horizontal axis of rotation causes a rotation of the locker about a vertical axis of rotation, and the rotation of the locker about the vertical axis of rotation disengages the locker and plate coupled thereto from the rack; and an elastic member positioned between the locker and the plate, wherein the elastic member returns the locker to an at rest position when the lever is returned to an at rest position from its rotation about the horizontal axis of rotation.

* * * * *